US007621785B2

(12) United States Patent
Lin

(10) Patent No.: US 7,621,785 B2
(45) Date of Patent: Nov. 24, 2009

(54) QUICK CONNECTOR FOR ELECTRIC HEATING TUBE

(75) Inventor: Heng-Yuan Lin, Taipei (TW)

(73) Assignee: Well Electronic Co., Ltd., Taipei (TW)

( * ) Notice: Subject to any disclaimer, the term of this patent is extended or adjusted under 35 U.S.C. 154(b) by 277 days.

(21) Appl. No.: 11/898,619

(22) Filed: Sep. 13, 2007

(65) Prior Publication Data

US 2009/0072529 A1 Mar. 19, 2009

(51) Int. Cl.
*H01R 13/24* (2006.01)

(52) U.S. Cl. ..... 439/700; 439/553; 439/954

(58) Field of Classification Search ..... 439/243, 439/244, 700, 553, 954
See application file for complete search history.

(56) References Cited

U.S. PATENT DOCUMENTS 1,875,844 A * 9/1932 Braunagel ..... 219/475
2,259,378 A * 10/1941 Heidkamper ..... 439/244
2,268,470 A * 12/1941 Bass et al. ..... 439/230
2,303,630 A * 12/1942 Goddard ..... 439/232
6,494,748 B1 * 12/2002 Mori et al. ..... 439/700

* cited by examiner

*Primary Examiner*—Neil Abrams
(74) *Attorney, Agent, or Firm*—Birch, Stewart, Kolasch & Birch, LLP

(57) ABSTRACT

A quick connector includes a main body externally provided with a bottom slot, an annular rib, and guiding recesses located above the annular rib, and internally defining a receiving space communicable at a lower end with the bottom slot via an opening; a lying U-shaped conductor extended through the opening with a lower end externally pressed against the bottom slot and an upper end located near an upper end of the receiving space for electrically connecting to an electric heating tube; and an elastic element mounted between the receiving space and the lying U-shaped conductor. The main body is mounted in an electric heating device via a mounting bracket engaged with the guiding recesses. With the elastic element, the lying U-shaped conductor may be elastically moved backward in the receiving space to enable convenient connecting or removing of the electric heating tube to or from the quick connector.

8 Claims, 6 Drawing Sheets

QUICK CONNECTOR FOR ELECTRIC HEATING TUBE

FIELD OF THE INVENTION

The present invention relates to a quick connector for an electric heating tube, and more particularly to a quick connector via which an electric heating tube may be conveniently mounted to or dismounted from an electric heating device.

BACKGROUND OF THE INVENTION

An electric heating device works based on the principle of hot air movement. There is a plurality of electric heating tubes sequentially arranged in an electric heating device. Each of the electric heating tubes has a tube body externally covered and contacting with a thermal conductive material. Two ends of each electric heating tube are fixedly connected to an inner surface of the electric heating device. Hot air produced by the electric heating tubes flows out of the electric heating device via a hot air outlet provided on the electric heating device.

It is noted the electric heating tubes are fixedly connected at two ends to the conventional electric heating device. Any mounting and dismounting of the electric heating tubes for the purpose of maintenance and replacement thereof must be done by a professional worker to avoid undesirable damage of the electric heating tubes or the whole electric heating device.

SUMMARY OF THE INVENTION

A primary object of the present invention is to provide a quick connector to allow convenient mounting and dismounting of an electric heating tube to and from an electric heating device via the quick connector, so that the electric heating device and the electric heating tubes thereof may be easily maintained and replaced.

To achieve the above and other objects, the quick connector for electric heating tube according to the present invention includes a main body being externally provided at a bottom with a slot, at a predetermined position with an annular rib, and above the annular rib with at least two guiding recesses extended between the annular rib and a top of the main body, and internally defining a receiving space communicable at a lower end with the bottom slot via an opening; a lying U-shaped conductor being mounted in the main body to extend through the opening and thereby locate between the receiving space and the bottom slot for electrically connecting at a top end to an electric heating tube; and an elastic element being mounted between the receiving space and the lying U-shaped conductor.

The main body is mounted to an inner side of an electric heating device via a mounting bracket engaged with the guiding recesses.

With the elastic element, the lying U-shaped conductor may be elastically pushed backward in the receiving space when the electric heating tube is pressed against the top end of lying U-shaped conductor, and may elastically restore to an initial position to electrically connect to the electric heat tube, enabling convenient mounting of the electric heating tube to the quick connector, and accordingly, the electric heating device. Similarly, the elastic element allows the electric heating tube to be quickly and conveniently removed from the quick connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
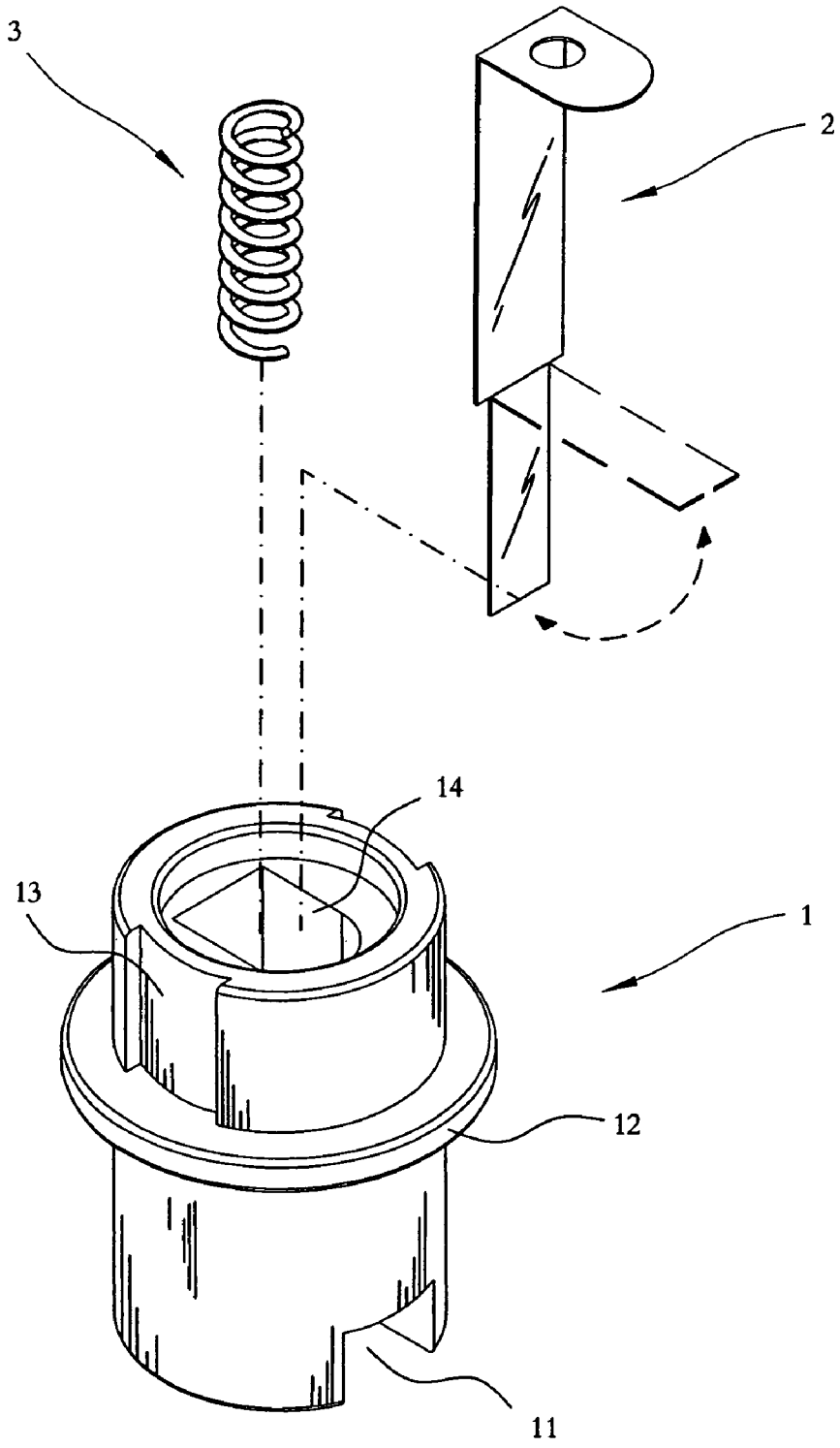
FIG. 1 is an exploded perspective view of a quick connector for electric heating tube according to the present invention.
Figure 2:
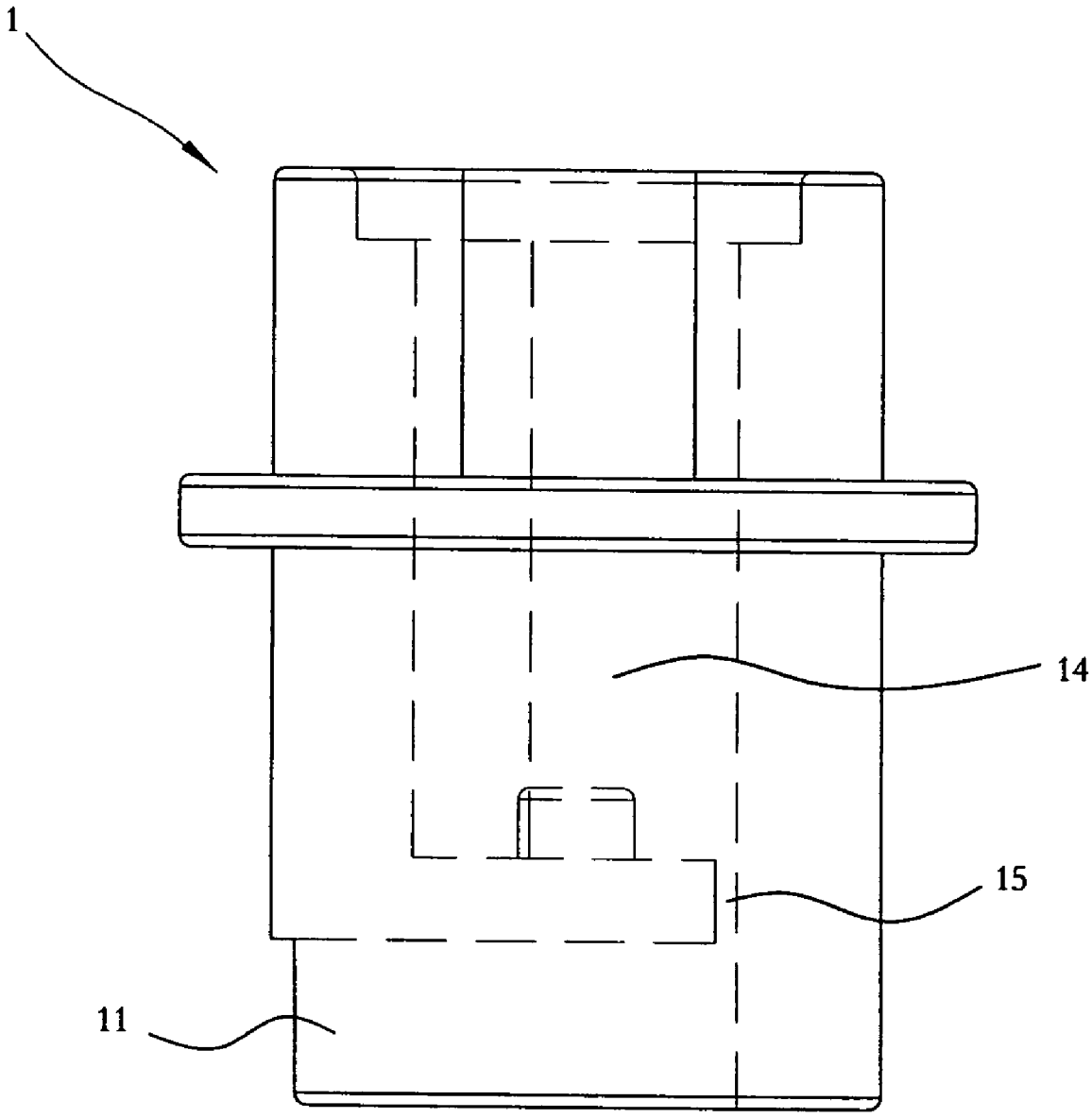
FIG. 2 is a vertical sectional view of a main body of the quick connector for electric heating tube shown in FIG. 1.

Please refer to FIG. 1 that is an exploded perspective view of a quick connector for electric heating tube according to the present invention. As shown, the quick connector includes a main body 1 being externally provided at a bottom with a slot 11. The main body 1 may be made of a ceramic material or any other electrically insulating and moldable material. The main body 1 is also externally provided at a predetermined position with an annular rib 12, and above the annular rib 12 with at least two symmetrically formed guiding recesses 13 having a predetermined depth in a thickness direction of the main body 1 and extended between the annular rib 12 and a top of the main body 1. The main body 1 internally defines a receiving space 14, which is communicable at a lower end with the bottom slot 11 via an opening 15, as can be seen from FIG. 2, which is a vertical cross sectional view of the main body 1.

A substantially lying U-shaped conductor 2 is extended through the opening 15 with a lower end bearing against a lower side of the bottom slot 11 and an upper end located near an upper end of the receiving space 14 for connecting to an electric heating tube. Two ends of the lying U-shaped conductor 2 may be properly bent to enable positioning of the conductor 2 in the receiving space 14, the opening 15, and the bottom slot 11. With the bent lower end of the lying U-shaped conductor 2 externally pressed against the bottom slot 11, the conductor 2 is prevented from being elastically pushed out of the main body 1 by an elastic element 3 mounted in the main body 1 between the receiving space 14 and the conductor 2.

The elastic element 3 may be a spring. Since it is located between the receiving space 14 and the conductor 2, the elastic element 3 may be confined to a predetermined area to be elastically compressed and elastically restore to an initial state when being released.

Figure 3:
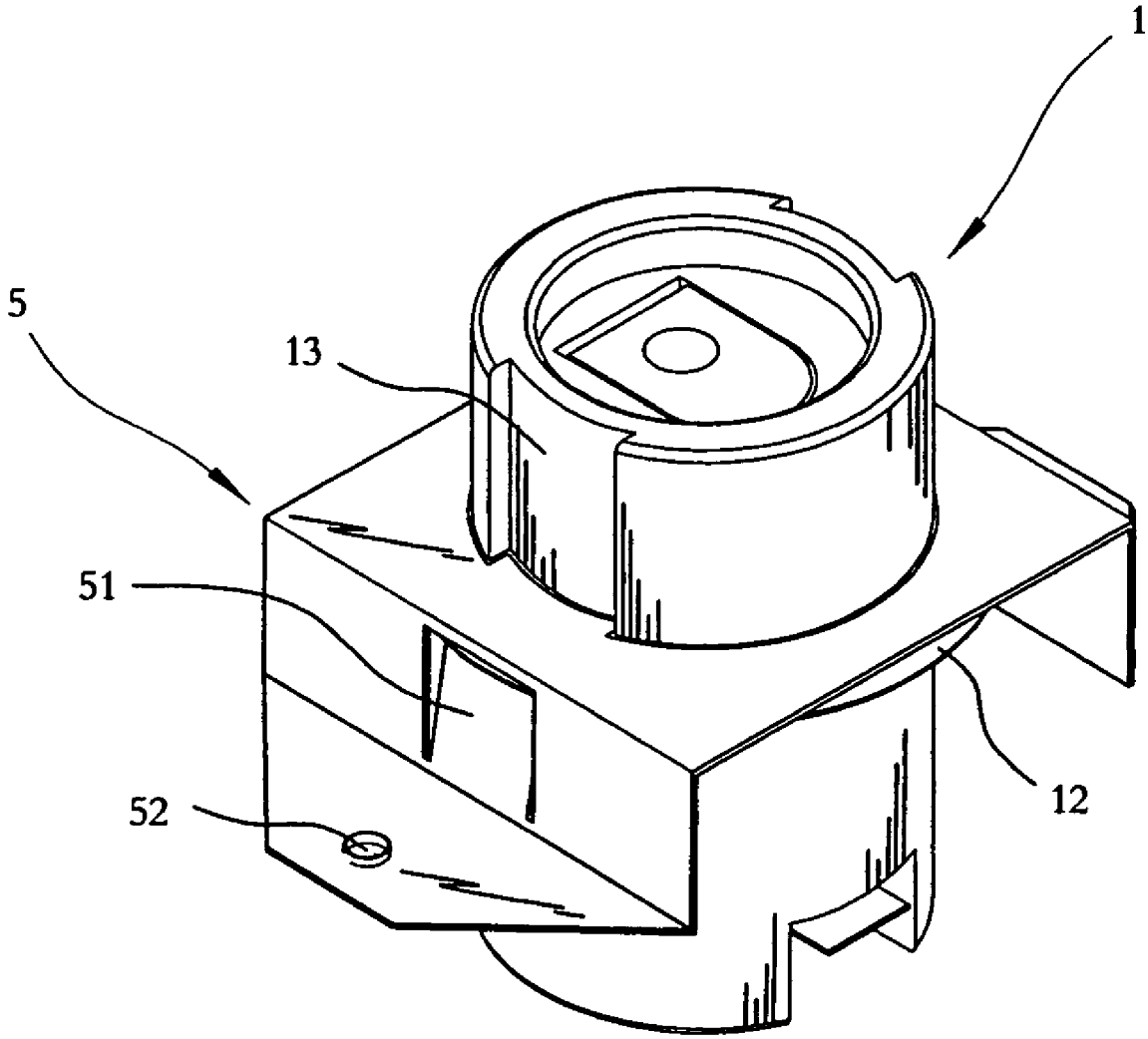
FIG. 3 is an assembled perspective view of the quick connector for electric heating tube according to the present invention used with a first type of mounting bracket.

The main body 1 is mounted onto a predetermined position in an electric heating device (not shown) via one or more mounting brackets. In FIG. 3, a first type of the mounting bracket 5 is shown. The mounting bracket 5 is suitably configured to fitly encircle the main body 1 above the annular rib 12 and engage with the guiding recesses 13. Therefore, the mounting bracket 5 does not turn relative to the main body 1. The mounting bracket 5 is fixedly connected at two opposite sides to an inner surface of the electric heating device (not shown) by extending fastening elements (not shown) through screw holes 52 formed on the two sides of the mounting bracket 5. Of course, the mounting bracket 5 may be connected to the inner surface of the electric heating device in other acceptable ways, such as, for example, by bonding. The mounting bracket 5 is further provided with two opposite holding-down tabs 51, which are properly tilted toward the main body 1 for pressing against the annular rib 12 on the main body 1.

Figure 4:
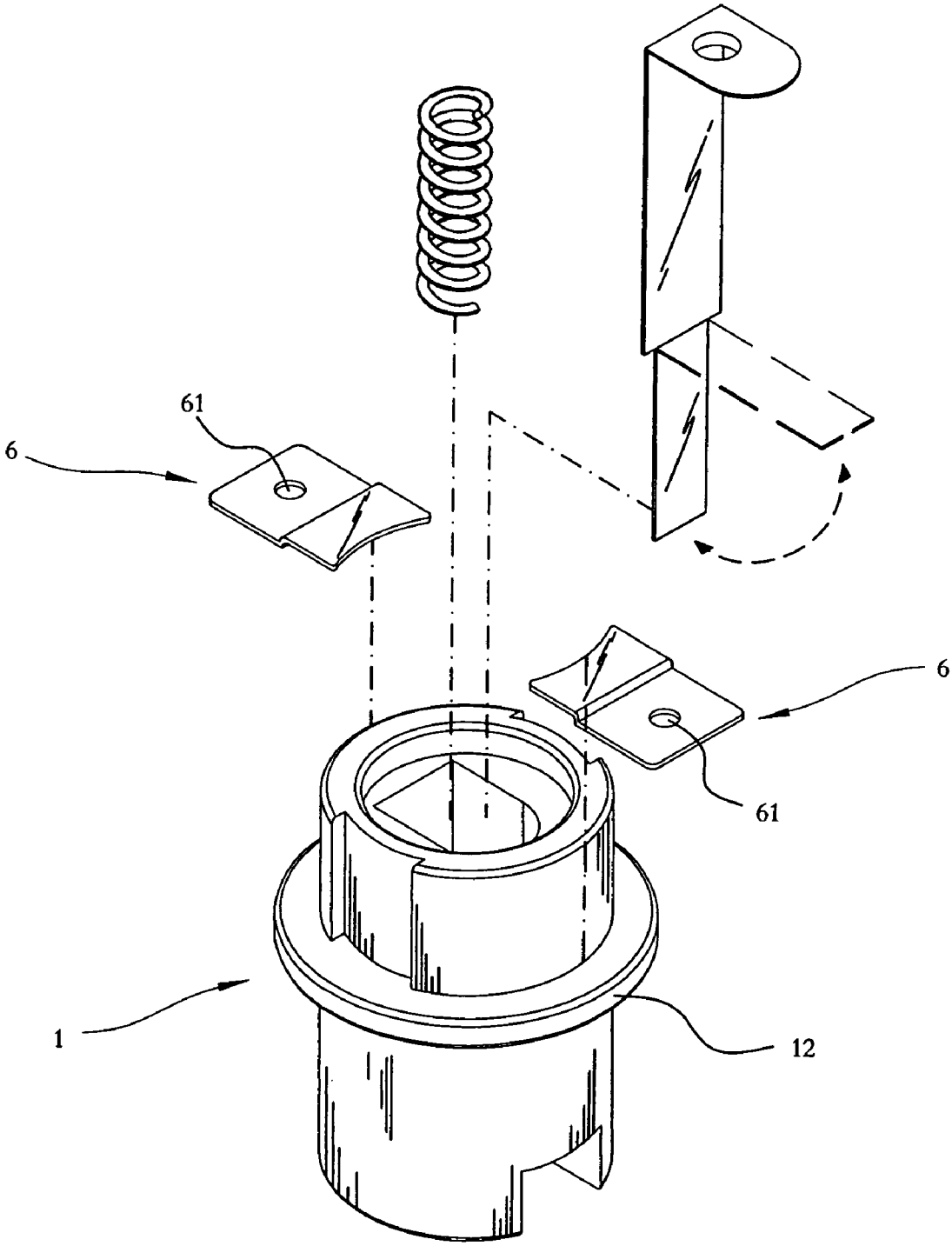
FIG. 4 is an exploded perspective view of the quick connector for electric heating tube according to the present invention used with a second type of mounting bracket.
Figure 5:
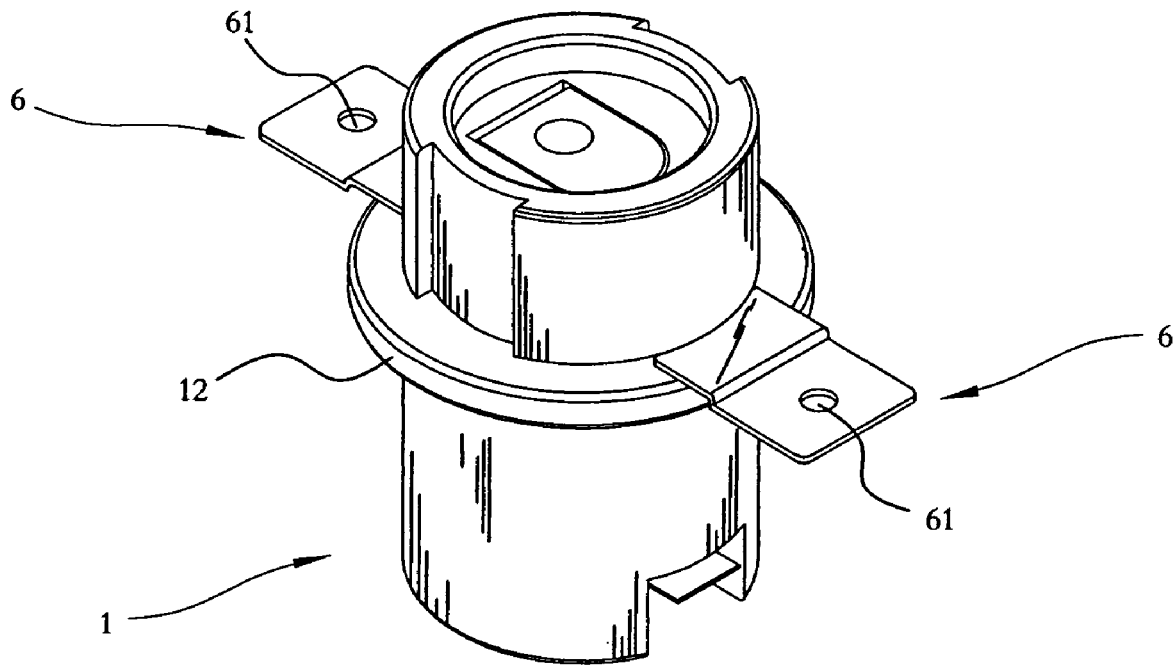
FIG. 5 is an assembled view of FIG. 4.

FIGS. 4 and 5 show the quick connector for electric heating tube according to the present invention is mounted onto a predetermined position in an electric heating device (not shown) via a second type of mounting bracket 6. At least two pieces of the mounting brackets 6 are used in this case. Each of the mounting brackets 6 is configured to have a curved inner end for fitly pressing against the main body 1 and a bent body for fitly bearing on a top of the annular rib 12. The mounting brackets 6 are connected at respective outer ends to an inner surface of the electric heating device (not shown) by extending fastening elements (not shown) through screw holes 61 formed on the outer ends of the mounting brackets 6.

Figure 6:
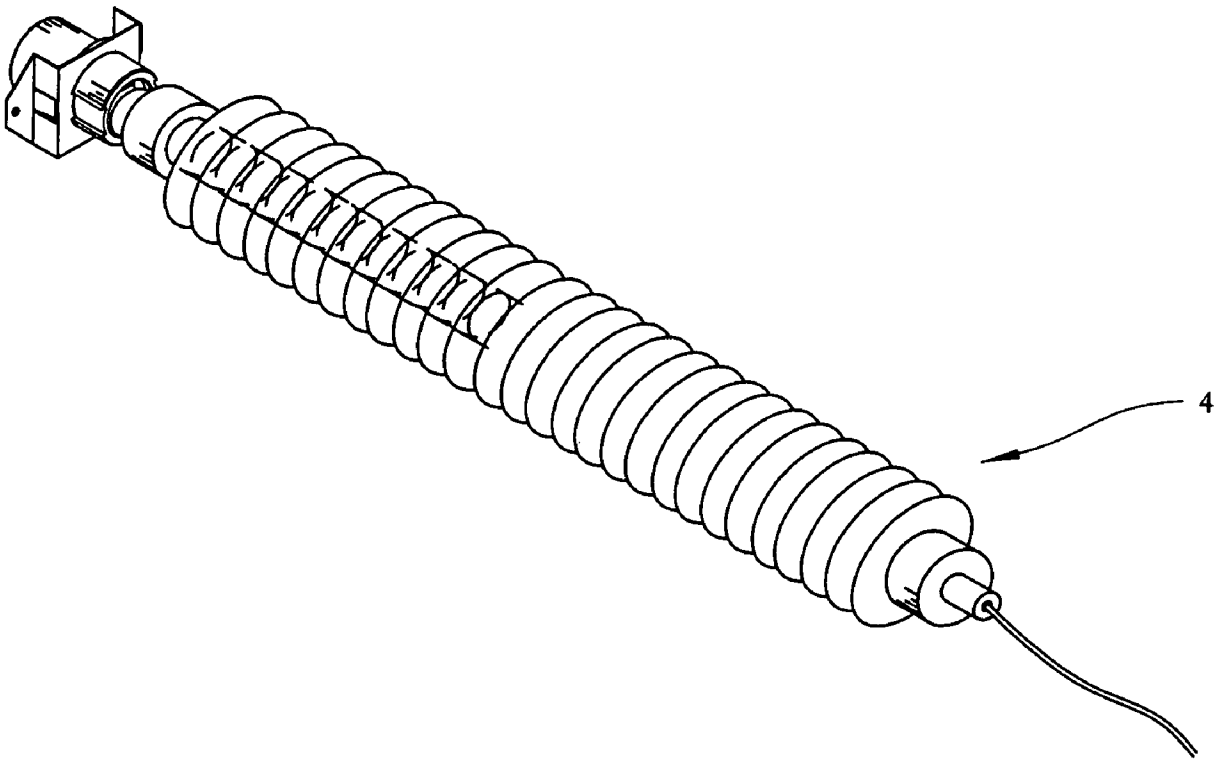
FIG. 6 shows the quick connector of the present invention having an electric heating tube electrically connected thereto.

FIG. 6 shows an electric heating tube 4 can be quickly electrically connected to or disconnected from the quick connector of the present invention simply by connecting or removing an end of the tube 4 to or from the upper end of the lying U-shaped conductor 2 located near the top of the quick connector.

With the quick connector of the present invention, an electric heating tube 4 may be conveniently mounted to or dismounted from an electric heating device by a user to facilitate general maintenance and repair of the electric heating device, making the electric heating device more practical and valuable for use.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A quick connector for electric heating tube, comprising:

a main body being externally provided at a bottom with a slot, at a predetermined position with an annular rib, and above the annular rib with at least two guiding recesses extended between the annular rib and a top of the main body, and internally defining a receiving space; the receiving space being communicable at a lower end with the bottom slot via an opening;

a lying U-shaped conductor being mounted in the main body to extend through the opening with an upper end located near an upper end of the receiving space and a lower end bearing against a lower side of the bottom slot, such that the lying U-shaped conductor is electrically connectable at the upper end to an electric heating tube; and an elastic element being mounted between the receiving space and the lying U-shaped conductor.

2. The quick connector for electric heating tube as claimed in claim 1, further comprising a mounting bracket mounted around the main body above the annular rib to fitly engage with the guiding recesses.

3. The quick connector for electric heating tube as claimed in claim 2, wherein the mounting bracket is connected at two opposite sides to an inner surface of an electric heating device.

4. The quick connector for electric heating tube as claimed in claim 2, wherein the mounting bracket further includes two opposite holding-down tabs for pressing against the annular rib on the main body.

5. The quick connector for electric heating tube as claimed in claim 2, wherein the mounting bracket are provided on two opposite sides with screw holes, via which fastening elements may be extended into an inner surface of an electric heating device.

6. The quick connector for electric heating tube as claimed in claim 1, further comprising at least two mounting brackets, each of the mounting brackets having a curved inner end for fitly pressing against the main body and a bent body for fitly bearing on a top of the annular rib, and being connected at an outer end to an inner surface of an electric heating device by extending fastening elements through screw holes formed on the outer end of the mounting bracket.

7. The quick connector for electric heating tube as claimed in claim 1, wherein the main body is made of a ceramic material.

8. The quick connector for electric heating tube as claimed in claim 1, wherein the elastic element is a spring.

* * * * *